US007816898B2

(12) United States Patent
Wong et al.

(10) Patent No.: US 7,816,898 B2
(45) Date of Patent: Oct. 19, 2010

(54) SWITCHING REGULATOR

(75) Inventors: Shih-Fang Wong, Taipei Hsien (TW); Tsung-Jen Chuang, Taipei Hsien (TW); Jun Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 635 days.

(21) Appl. No.: 11/768,920

(22) Filed: Jun. 27, 2007

(65) Prior Publication Data

US 2008/0150504 A1 Jun. 26, 2008

(30) Foreign Application Priority Data

Dec. 22, 2006 (CN) ..... 2006 1 0201368

(51) Int. Cl.
*G05F 1/40* (2006.01)

(52) U.S. Cl. ..... 323/282

(58) Field of Classification Search ..... 323/265, 323/273, 282, 303, 351, 361
See application file for complete search history.

(56) References Cited

U.S. PATENT DOCUMENTS 5,596,465 A * 1/1997 Honda et al. ..... 361/18
5,739,679 A * 4/1998 Takehara et al. ..... 323/299
6,107,851 A 8/2000 Balakirshnan et al.
6,160,388 A * 12/2000 Skelton et al. ..... 323/282
6,714,429 B2 3/2004 Phadke
6,737,827 B2 5/2004 Cashatt
7,394,231 B2 * 7/2008 Flatness et al. ..... 323/259
7,466,112 B2 * 12/2008 Zhou et al. ..... 323/259
2007/0069705 A1 * 3/2007 Umminger ..... 323/282
2007/0085519 A1 * 4/2007 Xu ..... 323/282

FOREIGN PATENT DOCUMENTS

CN 2741268 11/2005
JP 6351237 A 12/1994
JP 7067354 3/1995
JP 2000-270546 9/2000

* cited by examiner

*Primary Examiner*—Adolf Berhane
(74) *Attorney, Agent, or Firm*—Frank R. Niranjan

(57) ABSTRACT

A switching regulator includes an input terminal, a first time delay circuit, a first switch circuit, and an output terminal. The input terminal is for receiving an input current. The first time delay circuit is for delaying the input current. The first switch circuit is for receiving a first power-on voltage, and allowing the input current to flow therethrough. The output terminal is for outputting the input current.

19 Claims, 6 Drawing Sheets

SWITCHING REGULATOR

BACKGROUND OF THE INVENTION

1. Field of the Invention

The present invention generally relates to switching regulators, and more particularly to a switching regulator that can suppress an inrush current.

2. Description of Related Art

A switching regulator is connected to a power supply for receiving an input voltage and outputting an output voltage. The switching regulator typically includes an electrical switch, such as a metal-oxide semiconductor field-effect transistor (MOSFET) or a bipolar junction transistor (BJT), a capacitor, and a controller. The electrical switch is used for switchably applying the input voltage to the capacitor, and the capacitor is used for filtering the input voltage to form the output voltage. The output voltage is fed back to the controller. The controller adjusts a time span during which the electrical switch is switched on.

When the switching regulator is switched to the on state, an inrush current may be generated abruptly. The inrush current is extraordinarily greater than a normal input current. Referring to FIG. 5, for instance, the normal input current is lower than 50 A, whereas the inrush current rises to 100 A. Such a great inrush current may destroy the switching regulator. Therefore, it is necessary to suppress the inrush current, so as to protect the switching regulator from damage.

Referring to FIG. 6, a conventional switching regulator 900 is shown. The switching regulator 900 includes a rectifier D1, a filter C1, and a thermistor R1. The filter C1 is an electrolytic capacitor. The thermistor R1 is a resistor whose resistor varies with temperature. That is, the resistance of the thermistor R1 increases as the temperature decreases. An end of the thermistor R1 is electrically connected to a positive output end of the rectifier D1, and the other end of the thermistor R1 is electrically connected to a positive pole of the filter C1. A negative pole of the filter C1 is electrically connected to a negative output end of the rectifier D1.

When the switching regulator 900 is powered on, the rectifier D1 converts an alternating current to a direct current, and charges the filter C1 with the direct current via the thermistor R1. The resistor R1 can suppress the inrush current because of its characteristic.

However, the thermistor R1 does not cool down rapidly after the switching regulator 900 is powered off, the resistance of the thermistor R1 will not increase rapidly. Thus, if the switching regulator is promptly powered on, the thermistor R1 cannot suppress the inrush current.

Therefore, a new switching regulator is needed in the industry to address the aforementioned deficiencies and inadequacies.

SUMMARY OF THE INVENTION

A switching regulator includes an input terminal, a first time delay circuit, a first switch circuit, and an output terminal. The input terminal is for receiving an input current. The first time delay circuit is for delaying the input current. The first switch circuit is for receiving a first power-on voltage, and allowing the input current to flow therethrough. The output terminal is for outputting the input current.

Other features, and advantages of the present switching regulator will be or become apparent to one with skill in the art upon examination of the following drawings and detailed description. It is intended that all such additional systems, methods, features, and advantages be included within this description, be within the scope of the present device, and be protected by the accompanying claims.

BRIEF DESCRIPTION OF THE DRAWINGS

Many aspects of the present switching regulator can be better understood with reference to following drawings. Components in the drawings are not necessarily to scale, emphasis instead being placed upon clearly illustrating the principles of the present device. Moreover, in the drawings, like reference numerals designate corresponding parts throughout the several views.

DETAILED DESCRIPTION OF THE INVENTION

Reference will now be made to the drawings to describe a preferred embodiment of the present switching regulator.

Figure 1:
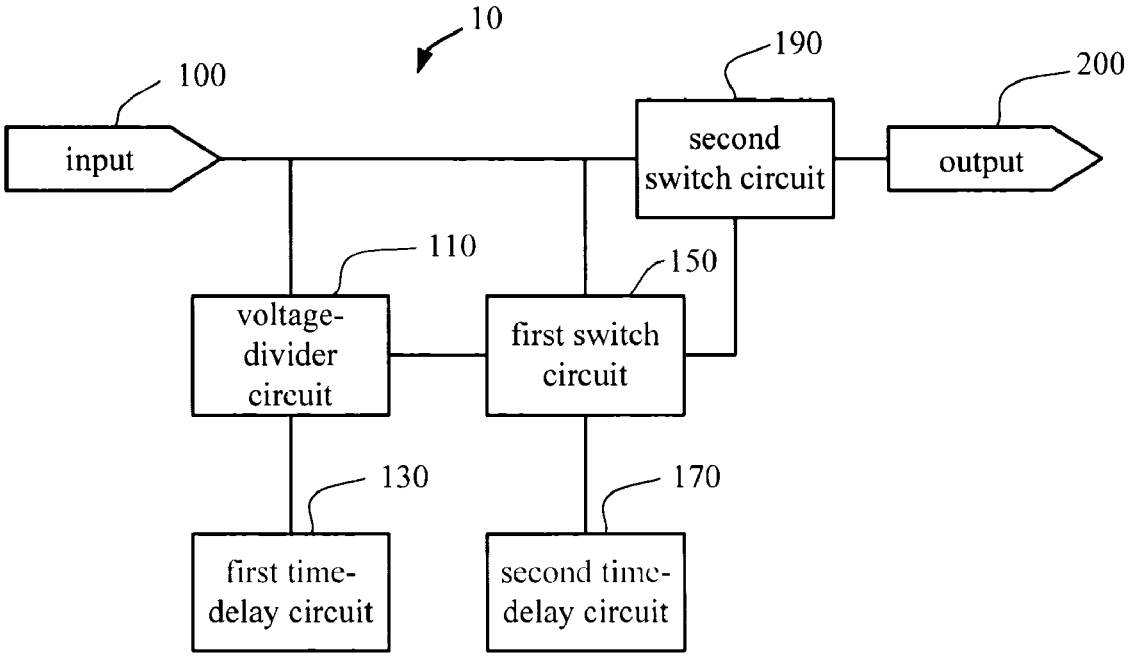
FIG. 1 is a block diagram showing a switching regulator in accordance with an exemplary embodiment of the present invention.

Referring to FIG. 1, a switching regulator 10 in accordance with a preferred exemplary embodiment is for regulating an input current. The switching regulator 10 includes an input terminal 100, a voltage-divider circuit 110, a first time-delay circuit 130, a first switch circuit 150, a second time-delay circuit 170, a second switch circuit 190, and an output terminal 200.

The input terminal 100 is electrically connected to the voltage-divider circuit 110, the first switch circuit 150, and the second switch circuit 190. The first time-delay circuit 130 is electrically connected to the voltage-divider circuit 110. The first switch circuit 150 is electrically connected to the voltage-divider circuit 110, the second time-delay circuit 170, and the second switch circuit 190. The output terminal 200 is electrically connected to the second switch circuit 190.

The input terminal 100 is used for receiving the input current. The voltage-divider circuit 110 is for allowing the input current to flow from the input terminal 100 to the first time-delay circuit 130, and providing a first power-on voltage to the first switch circuit 150. The first time-delay circuit 130 and the second time-delay circuit are both configured for delaying the input current. The first switch circuit 150 is for conducting the first power-on voltage to the second time-delay circuit 170. A second power-on voltage is generated by the first switch circuit 150 and is then sent to the second switch circuit 190. The second switch circuit 190 is used for receiving the second power-on voltage, and allowing the input current to flow to the output terminal 200.

Figure 2:
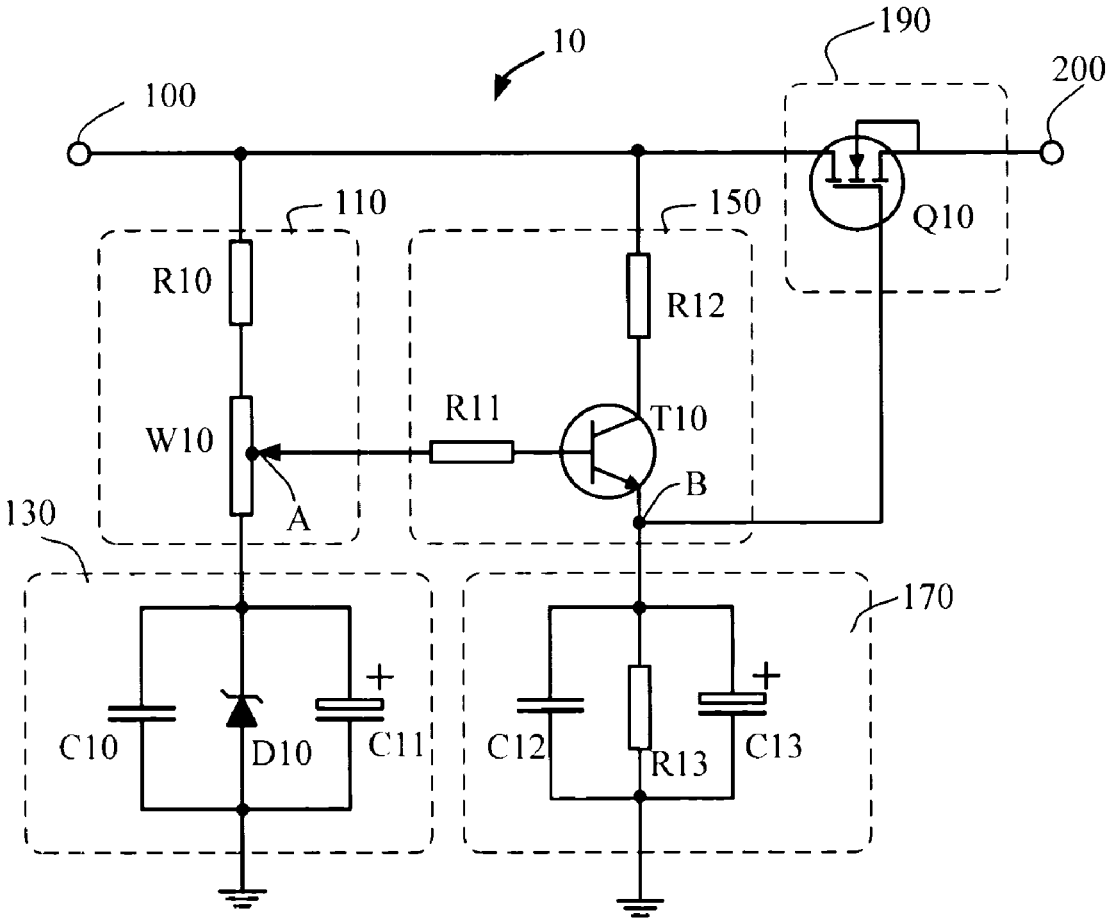
FIG. 2 is a schematic diagram showing a concrete structure of the switching regulator of FIG. 1.

Referring to FIG. 2, a detailed structure of the switching regulator 10 is illustrated. The voltage-divider circuit 110 includes a resistor R10 and a variable resistor W10. An end of the resistor R10 is electrically connected to the input terminal 100, and another end of the resistor R10 is electrically connected to an end of the variable resistor W10. Another end of the variable resistor W10 is electrically connected to the first time-delay circuit 130, and a wiper of the variable resistor W10 is electrically connected to the first switch circuit 150.

The first time-delay circuit 130 includes a capacitor C10, a Zener diode D10, and a capacitor C11. An end of the capacitor C10, a negative end of the Zener diode D10, and a positive end of the capacitor C11 are electrically connected to the variable resistor W10. Another end of the capacitor C10, a positive end of the Zener diode D10, and a negative end of the capacitor C11 are grounded.

The first switch circuit 150 includes an input resistor R11, a pull-up resistor R12, and an NPN bipolar junction transistor (BJT) T10. An end of the input resistor R11 is electrically connected to the wiper of the variable resistor W10, and another end of the input resistor R11 is electrically connected to a base of the NPN BJT T10. An end of the pull-up resistor R12 is electrically connected to the input terminal 100, and another end of the pull-up resistor R12 is electrically connected to a collector of the NPN BJT T10. An emitter of the NPN BJT T10 is electrically connected to the second time-delay circuit 170 and the second switch circuit 190. The NPN BJT T10 acts as an electronic switch, and it can also be substituted with a PNP BJT or a metal-oxide semiconductor field-effect transistor (MOSFET).

The second time-delay circuit 170 includes a capacitor C12, a pull-down resistor R13, and a capacitor C13. An end of the capacitor C12, an end of the pull-down resistor R13, and a positive end of the capacitor C13 are electrically connected to the emitter of the NPN BJT T10. Another end of the capacitor C12, another end of the pull-down resistor R13, and a negative end of the capacitor C13 are grounded.

The second switch circuit 190 is a MOSFET Q10. A drain of the MOSFET Q10 is electrically connected to the input terminal 100, a gate of the MOSFET Q10 is electrically connected to the emitter of the BJT T10, and a source of the MOSFET Q10 is electrically connected to the output terminal 200. In this embodiment, a substrate of the MOSFET Q10 is electrically connected to the source to prevent the input current from flowing to the substrate.

Before the switching regulator starts to work, the BJT T10 and the MOSFET Q10 are set off. When the switching regulator starts to work, the input current is led to charge the capacitor C11. Subsequently, the voltage of the base of the BJT T10 rises as the charge on the capacitor C11 increases. When the voltage of the base of the BJT T10 rises to a predetermined value, the BJT T10 allows the input current to flow from its collector to its emitter.

Herein, the Zener diode D10 is for protecting the capacitor C11 from being destroyed. When a voltage on the capacitor C11 rises to a breakdown value of the Zener diode D10, the Zener diode D10 prevents the voltage on the capacitor C11 from increasing. The capacitor C10 is for filtering out noise of the input current.

Subsequently, the input current is led to charge the capacitor C13. A voltage of the gate of the MOSFET Q10 grows higher as a coulomb of the capacitor C13 increases. When the voltage of the gate of the MOSFET Q10 rises to a predetermined value, the MOSFET Q10 allows the input current to flow to the output terminal 200.

When the switching regulator 10 stops working, the BJT T10 and the MOSFET Q10 are both opened. At the moment, the capacitor C11 discharges via the variable resistor W10, the input resistor R11, and the pull-down resistor R13, and the capacitor C13 discharges via the pull-down resistor R13.

Figure 3:
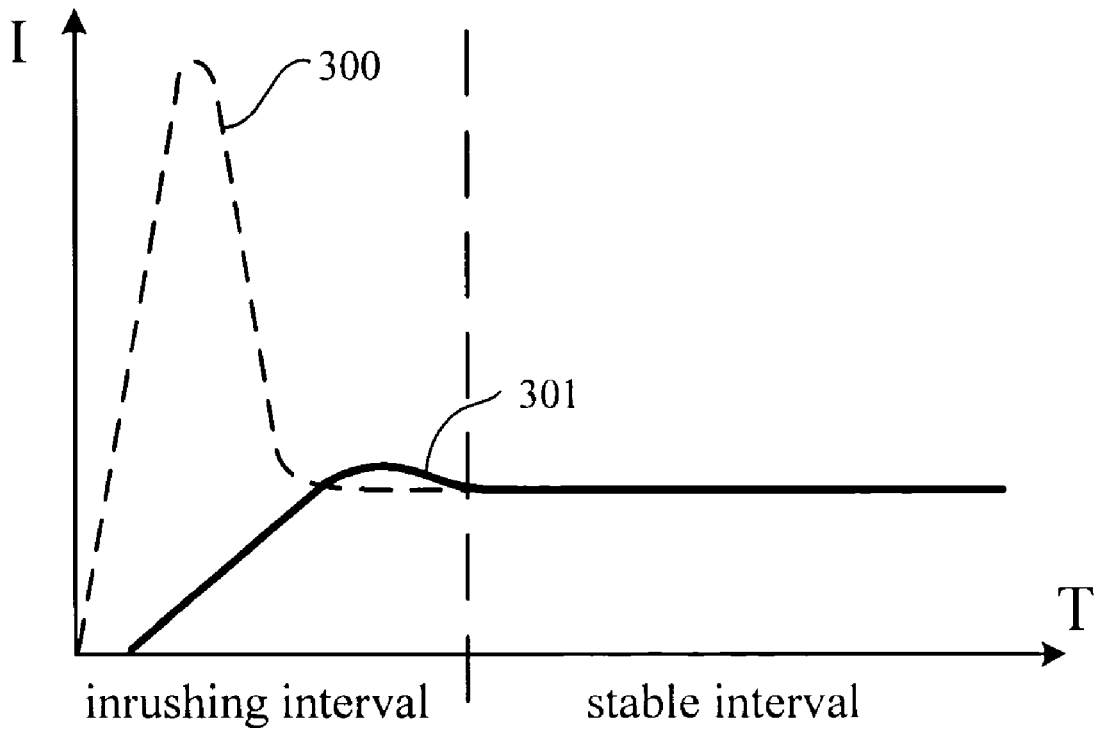
FIG. 3 is a graph showing variation of a current of the switching regulator.
Figure 4:
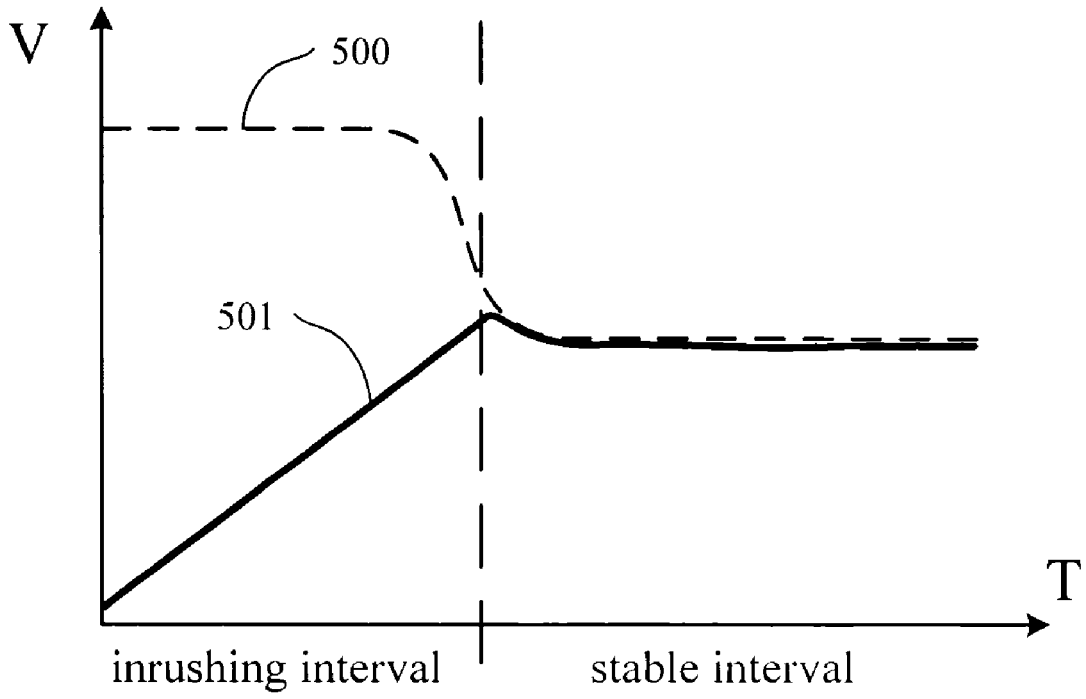
FIG. 4 is a graph showing variation of a voltage of the switching regulator.
Figure 5:
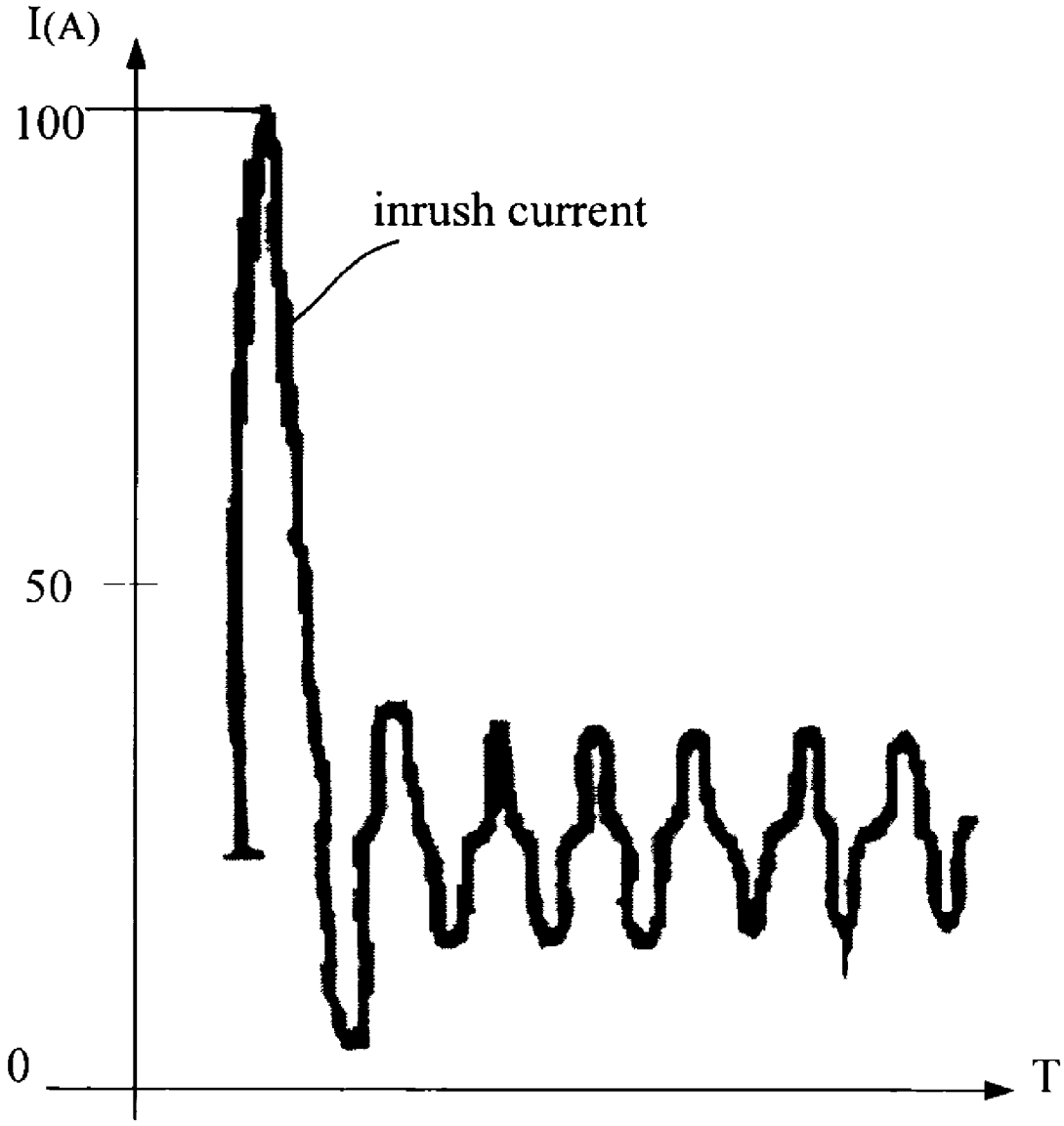
FIG. 5 is a graph showing variation of an inrush current.
Figure 6:
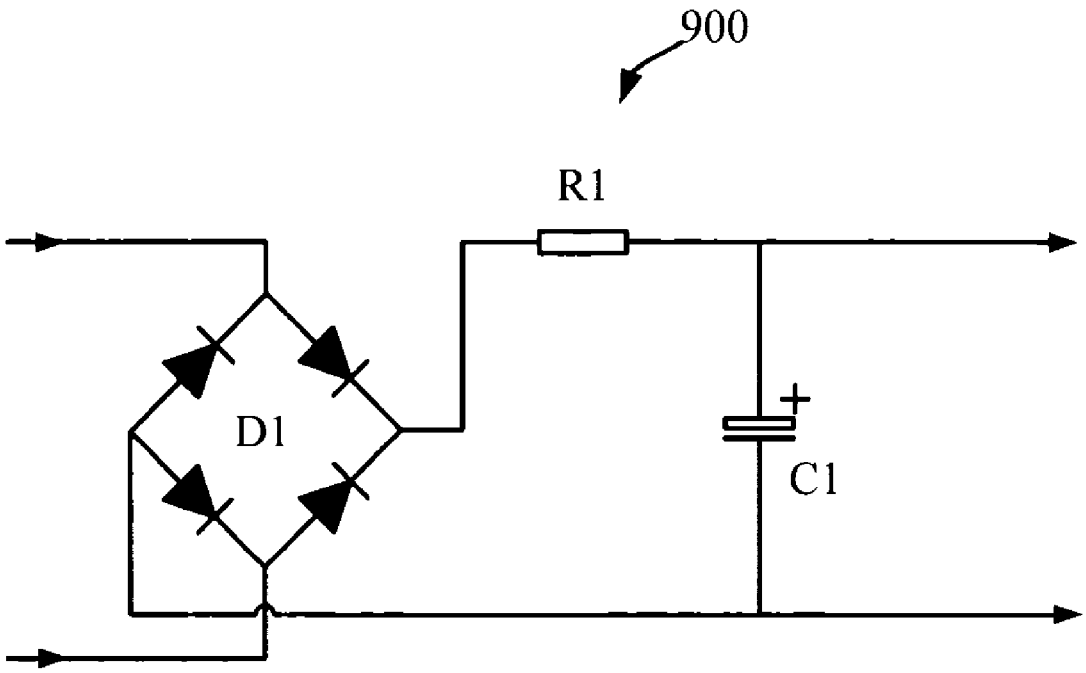
FIG. 6 (RELATED ART)
FIG. 6 is a schematic diagram showing a conventional switching regulator.

Referring to FIGS. 3, and 4, an input current 300, an output current 301, an input voltage 500, and an output current of the switching regulator 10 are illustrated. In an inrushing interval the input current 300 has an inrush value, whereas the output current 301 and the output voltage 501 both rise to a stable value gradually.

The switching regulator 10 uses the first time-delay circuit 130 and the second time-delay circuit 170 to delay or absorb the inrush current, so as to protect subsequent circuits. Furthermore, the switching regulator also uses the MOSFET Q10 for controlling the output current to rise stably. Specifically, when the switching regulator 10 stops working, the capacitor C11 and capacitor C13 discharge, and then the switching regulator 10 returns to its initial state.

It should be emphasized that the above-described preferred embodiment, is merely a possible example of implementation of the principles of the invention, and is merely set forth for a clear understanding of the principles of the invention. Many variations and modifications may be made to the above-described embodiment of the invention without departing substantially from the spirit and principles of the invention. All such modifications and variations are intended to be included herein within the scope of this disclosure and the present invention and be protected by the following claims.

What is claimed is:

1. A switching regulator comprising:

an input terminal configured for receiving an input current;

a first capacitor with a positive end electrically connected to the input terminal, and a negative end grounded, the first capacitor being charged by the input current when the input the terminal receives the input current;

a first electronic switch electrically connected to the positive end of the first capacitor, and turned on when the charge on the first capacitor increases to a predetermined value;

a second capacitor with a positive end electrically connected to the first electronic switch, and a negative end grounded, the second capacitor being charged by the input current when the first electronic switch is turned on;

a second electronic switch electrically connected to the first electronic switch, and turned on when the charge on the second capacitor increases to a predetermined value; and an output terminal electrically connected to the second electronic switch, the output terminal configured for outputting the input current when the second electronic switch is turned on.

2. The switching regulator according to claim 1, further comprising a first resistor electrically connected between the input terminal and the first electronic switch.

3. The switching regulator according to claim 2, further comprising a second resistor electrically connected between the first electronic switch and the first capacitor.

4. The switching regulator according to claim 3, further comprising a variable resistor, and an end of the variable resistor is electrically connected to the first resistor, and another end of the variable resistor is electrically connected to the first capacitor, and a wiper of the variable resistor is electrically connected to the second resistor.

5. The switching regulator according to claim 4, further comprising a third capacitor connected to the first capacitor in parallel.

6. The switching regulator according to claim 1, further comprising a Zener diode, and a negative end of the Zener diode is electrically connected to the positive end of the first capacitor, and a positive end of the Zener diode is grounded.

7. The switching regulator according to claim 1, wherein the first electronic switch is an NPN bipolar junction transistor.

8. The switching regulator according to claim 7, wherein the positive end of the second capacitor is electrically connected to an emitter of the NPN bipolar junction transistor, and a negative end of the second capacitor is grounded.

9. The switching regulator according to claim 8, further comprising another capacitor connected to the second capacitor in parallel.

10. The switching regulator according to claim 9, further comprising a resistor connected to the second capacitor in parallel.

11. The switching regulator according to claim 7, wherein the second electronic switch is a metal-oxide semiconductor field-effect transistor, and a gate of the metal-oxide semiconductor field-effect transistor T is electrically connected to an emitter of the NPN bipolar junction transistor, and a drain of the metal-oxide semiconductor field-effect transistor is electrically connected to the input terminal, and a source of the metal-oxide semiconductor field-effect transistor is electrically connected to the output terminal.

12. A switching regulator comprising:

an input terminal configured for receiving an input current;

an output terminal configured for outputting the input current;

a first time delay circuit configured for delaying the input current;

a second time delay circuit configured for delaying the input current;

a voltage-divider circuit configured for conducting the input current to the first time-delay circuit, and generating a first power-on voltage;

a first switch circuit configured for receiving the first power-on voltage, conducting the first power-on voltage to the second time delay circuit, and generating a second power-on voltage;

a second switch circuit configured for receiving the second power-on voltage, and allowing the input current to flow from the input terminal to a output terminal.

13. The switching regulator according to claim 12, wherein the first time delay circuit comprises a capacitor for charged with the input current.

14. The switching regulator according to claim 13, wherein the first time delay circuit comprises a Zener diode parallel connected to the capacitor to protect the capacitor from being destroyed by overcharging.

15. The switching regulator according to claim 12, wherein the voltage-divider circuit comprises a variable resistor electrically connected between the input terminal and the first time delay circuit, and a wiper of the variable resistor for conducting the first power-on voltage to the first switch circuit.

16. The switching regulator according to claim 12, wherein first switch circuit comprises a NPN bipolar junction transistor.

17. The switching regulator according to claim 12, wherein the second time delay circuit comprises a capacitor for being charged with the input current.

18. The switching regulator according to claim 17, wherein the second time delay circuit further comprises a resistor parallel connected to the capacitor.

19. The switching regulator according to claim 12, further comprising a second switch circuit for receiving a second power-on voltage, and conducting the input current to the output terminal after the second switch circuit is closed.

* * * * *